United States Patent [19]

Hewlett, Jr.

[11] 4,451,039

[45] May 29, 1984

[54] MAGIC OCTAHEDRON

[76] Inventor: Clarence W. Hewlett, Jr., 920 Northgate Ave., Waynesboro, Va. 22980

[21] Appl. No.: 347,183

[22] Filed: Feb. 9, 1982

[51] Int. Cl.[3] ..... A63F 9/08

[52] U.S. Cl. ..... 273/153 S

[58] Field of Search ..... 273/153 R, 153 S, 155

[56] References Cited

FOREIGN PATENT DOCUMENTS

| | | | |
|---|---|---|---|
| 42695 | 12/1981 | European Pat. Off. | 273/153 S |
| 8104382 | 7/1981 | Fed. Rep. of Germany | 273/153 S |
| 8103050 | 12/1981 | Fed. Rep. of Germany | 273/153 S |
| 170062 | 12/1977 | Hungary | 273/153 S |
| 55-3956 | 1/1980 | Japan | 273/153 S |
| 2084471 | 4/1982 | United Kingdom | 273/153 S |

*Primary Examiner*—Anton O. Oechsle

[57] ABSTRACT

A mechanical puzzle in the shape of a regular octahedron is provided, comprising a plurality of component octahedra and component tetrahedra. Such components are retained as a unit. The entire set of component parts which constitute a single face is adapted to be rotated 120 degrees about an axis perpendicular to any face.

10 Claims, 10 Drawing Figures

MAGIC OCTAHEDRON

BACKGROUND OF THE INVENTION

The invention relates to improved mechanical puzzles.

The invention relates more particularly to a class of mechanical puzzles in which a plurality of component parts are held together to form a unit, but subsets of these parts can, nevertheless, be moved in certain ways to cause a rearrangement of the parts, while the assembly of component parts still remains a unit. A well-known example of this class of puzzle is sometimes referred to as the magic cube.

The general shape of the present invention is a regular octahedron (eight faces, each of which is an equilateral triangle) which differs substantially from the magic cube (which has six faces, each of which is a square). Also, the component parts of the present invention are regular octahedra and regular tetrahedra, whereas the component parts of the magic cube are cubes. Also, whereas the magic cube has faces which rotate about three mutually perpendicular axes, the magic octahedron has faces which rotate about four different axes, none of which are perpendicular to each other. Finally, in this invention a face is rotated 120 degrees clockwise or counterclockwise, whereas a face is rotated 90 degrees or 180 degrees in the case of the magic cube.

Also known in the prior art is a magic tetrahedron with a smaller number of parts than the cube and the present invention, and which is, consequently, less challenging.

OBJECTS OF THE INVENTION

It is therefore an object of this invention to provide a new and more challenging puzzle which is substantially different from the prior art and has a greater number of movable pieces.

It is a further object of this invention to provide a puzzle of entertainment interest.

It is also an object of this invention to provide an attractive and challenging puzzle with the pleasing shape of a regular octahedron.

It is a further object of this invention to provide a puzzle whose faces are colored or provided with other distinctive markings.

It is a further object of this invention to provide a magic octahedron whose faces can be given a few random twists, and the object of the puzzle is then to restore the magic octahedron it its "start" position in which a single color or distinctive marking is presented on each face.

SUMMARY OF THE INVENTION

In accordance with the general features of the present invention a mechanical puzzle is provided in the shape of a regular octahedron, having means to retain a plurality of component octahedra and component tetrahedra into a single unit. Each of the faces of the main unit is subdivided into nine smaller equilateral triangles which are themselves faces of the component octahedra and the component tetrahedra. The entire set of component parts which constitute a single face may be rotated 120 degrees about an axis perpendicular to this face. In this way a new arrangement of the parts comes about, while the entire assembly of component parts remains a unit.

BRIEF DESCRIPTION OF THE DRAWINGS

The subject matter of the invention is particularly pointed out and distinctly claimed in the concluding portion of the specification. For a complete understanding of one embodiment of the invention together with other objects and advantages thereof, reference should be made to the following description taken in conjunction with the accompanying drawings in which:

DETAILED DESCRIPTION

Figure 1A:
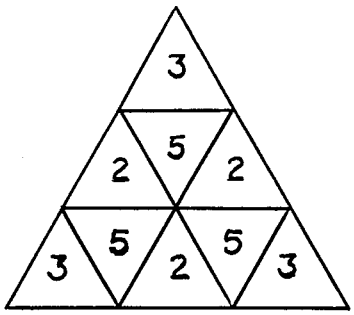
FIG. 1A is a view of the top surface of the puzzle with the puzzle sitting on a horizontal surface.

A prior art magic cube can be described mathematically as an assembly of 27 small cubes. One of these is at the center of the assembly and, therefore, never seen. In a similar way the magic octahedron can be described mathematically as an assembly of 51 small parts, 19 of which are small octahedra and 32 of which are small tetrahedra. While it is relatively easy to visualize the assembly of 27 small cubes, it is much more difficult to visualize the assembly of small octahedra and tetrahedra which constitute the magic octahedron of the present invention. The following notes together with the drawings will aid in this visualization.

1. The 19 small octahedra are regular octahedra.
2. The 32 small tetrahedra are regular tetrahedra.
3. The individual faces of the small octahedra are equilateral triangles, as are the individual faces of the small tetrahedra.

Also, the faces of the small tetrahedra are identical in size to the faces of the small octahedra.

4. When the small parts are assembled to make the entire unit, the following rule is invariably observed: A small octahedron face is always adjacent to a small tetrahedron face or exposed to the outside world. A small tetrahedron face is always adjacent to a small octahedron face or exposed to the outside world.

5. There are three categories of octahedra and two categories of tetrahedra as follows:

(a) There is one center octahedron at the very center of the assembly which presents no face to the outside world and is, therefore, never seen.

(b) There are 12 edge octahedra, one at the center of each of the 12 edges of the overall assembly. Each of these 12 edge octahedra presents 2 faces to the outside world.

(c) There are 6 corner octahedra, one at each corner of the overall assembly. Each of these corner octahedra presents 4 faces to the outside world.

(d) There are 8 interior tetrahedra each of which presents no face to the outside world and is, therefore, never seen. One of these 8 interior tetrahedra is adjacent to each of the 8 faces of the center octahedron, thus completely covering it.

(e) There are 24 exterior tetrahedra. Essentially as referenced herein, feet are intended to mean projections beyond the normal boundary of the component tetrahedron or octahedron shapes, whereas the cut away portions are intended to mean the parts that are removed from within the normal boundary of the component tetrahedron or octahedron shapes. Each of these exterior tetrahedra presents one face to the outside world and fills the spaces between the edge octahedra and the corner octahedra.

The above notes should make it possible to visualize the assembly of the 51 small parts. The categories of small parts (a) through (e) described above have great relevance to one embodiment of the present invention which will now be described.

I. The center octahedron is reduced in size and has tapped holes into the center of each of its 8 faces to accept screws about which the individual faces of the entire assembly can pivot. In fact, this center octahedron may cease to resemble an octahedron and take a spherical or other shape, as long as it has 8 tapped holes in it at the proper angular relationship.

II. The 12 edge octahedra will be made so as to be identical to each other. Parts of these octahedra will be cut away as described later and parts called feet will be attached to them.

III. The 6 corner octahedra will likewise be identical geometrically to each other. Nothing will be cut away from these octahedra, but they too will have feet attached to them.

IV. The 8 interior tetrahedra will be identical to each other but will be severely cut away so that they will scarcely resemble tetrahedra any more. These parts have no feet.

V. The 24 exterior tetrahedra are also identical geometrically to each other. A small part of each is cut away and they also have feet.

Figure 1B:
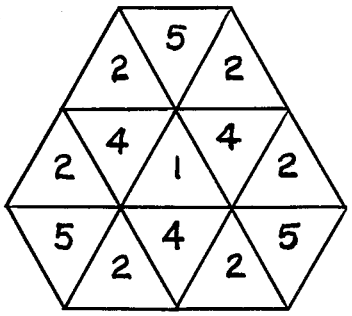
FIG. 1B is a view of an interior horizontal surface of the puzzle as seen from above with one layer (of three layers altogether) of component parts removed.
Figure 1C:
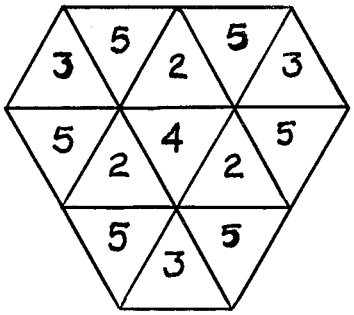
FIG. 1C is a view of another interior horizontal surface of the puzzle as seen from above with two layers (of three layers altogether) of component parts removed.

The center octahedron needs no further description other than that given above under I. As an introduction to the further detailed description of the other parts, FIG. 1A shows a view of the top surface of the assembly, FIG. 1B shows a view of an interior surface of the assembly as seen when looking down at the lower two-thirds, with the top one-third (a single layer) removed, and FIG. 1C is a view of another interior surface of the assembly as seen when looking down at the lower one-third, with the top two-thirds (two layers) removed. The triangular faces shown are faces of the component parts having the following identification: 1 for center octahedron, 2 for edge octahedra, 3 for corner octahedra, 4 for interior tetrahedra and 5 for exterior tetrahedra.

Figure 2A:
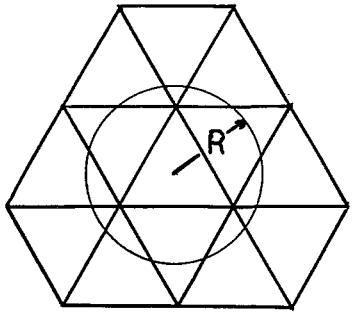
FIG. 2A is a modification of FIG. 1B useful in explaining how the component parts of the puzzle are retained.

FIG. 2A is useful in explaining how the component parts are held together by feet projecting into openings under adjacent components. FIG. 2A shows exactly the same view as in FIG. 1B except that the numbers have been removed and a circle of radius R has been added with its center at the center of the face of the center octahedron. The radius R of this circle is equal to, or somewhat less than, the altitude of one of the triangular faces.

Figure 2B:
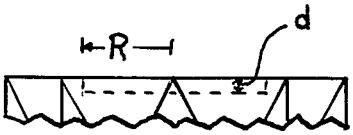
FIG. 2B is a side view of FIG. 2A.

It will help to understand the mechanism to realize that material is cut away inside the circle to a certain depth d below the plane of the faces in FIG. 2A. This depth d may typically be about one tenth of the altitude of one of the triangular faces, but other values for the depth are also possible. FIG. 2B shows the cut 11 described as seen from the side while FIG. 2A is seen from the top.

If the cut just described is now repeated in the surface under each of the 8 faces of the overall assembly, the total material removed will define the minimum cut away material alluded to under I, II, IV, and V. The feet alluded to under II, III, and V are extra material added to the component parts on certain faces. This extra material projects beyond the normal boundaries of these component parts into the space vacated by the cuts previously described.

Figure 3:
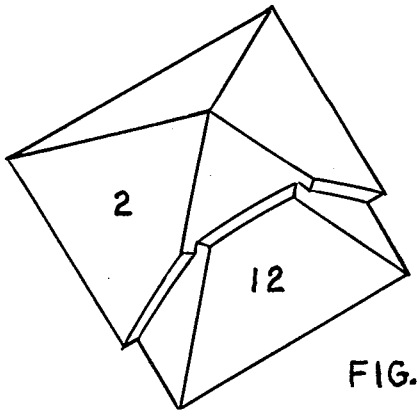
FIG. 3 is a view of an edge octahedron with attached feet and cut-away portions.

FIG. 3 shows a view of an edge octahedron 2 with parts cut away on four interior faces and with feet 12 added on the two other interior faces.

Figure 4:
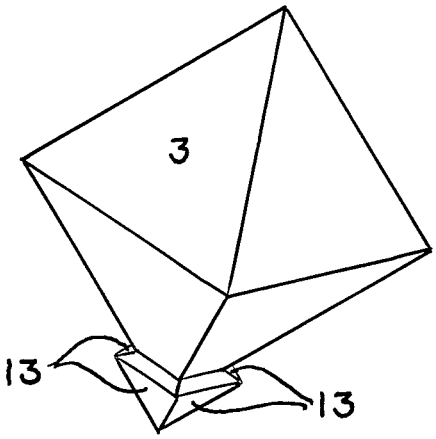
FIG. 4 is a view of a corner octahedron with attached feet.

FIG. 4 shows a view of a corner octahedron 3 with four feet 13 added on four interior faces.

Figure 5:
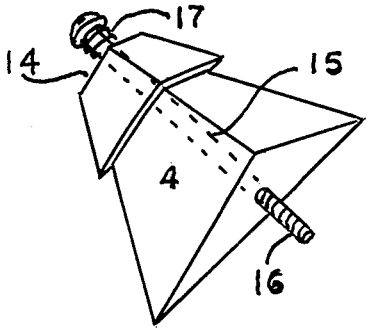
FIG. 5 is a detailed drawing of an interior tetrahedron with extensive cut-away parts.

FIG. 5 shows a view of an interior tetrahedron 4 with parts cut away on three faces to accept the feet of adjacent parts and a further cut 14 (at the upper left of the figure) and a hole 15 to accept a screw 16 and a spring 17, if necessary, to facilitate holding the parts together, particularly during movement.

Figure 6:
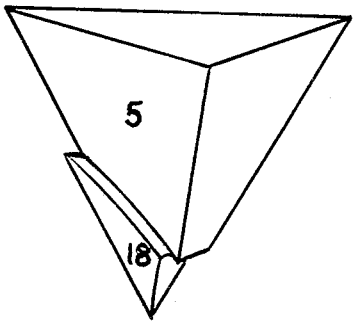
FIG. 6 is a view of an exterior tetrahedron with attached feet and a cut-away portion.
Figure 7:
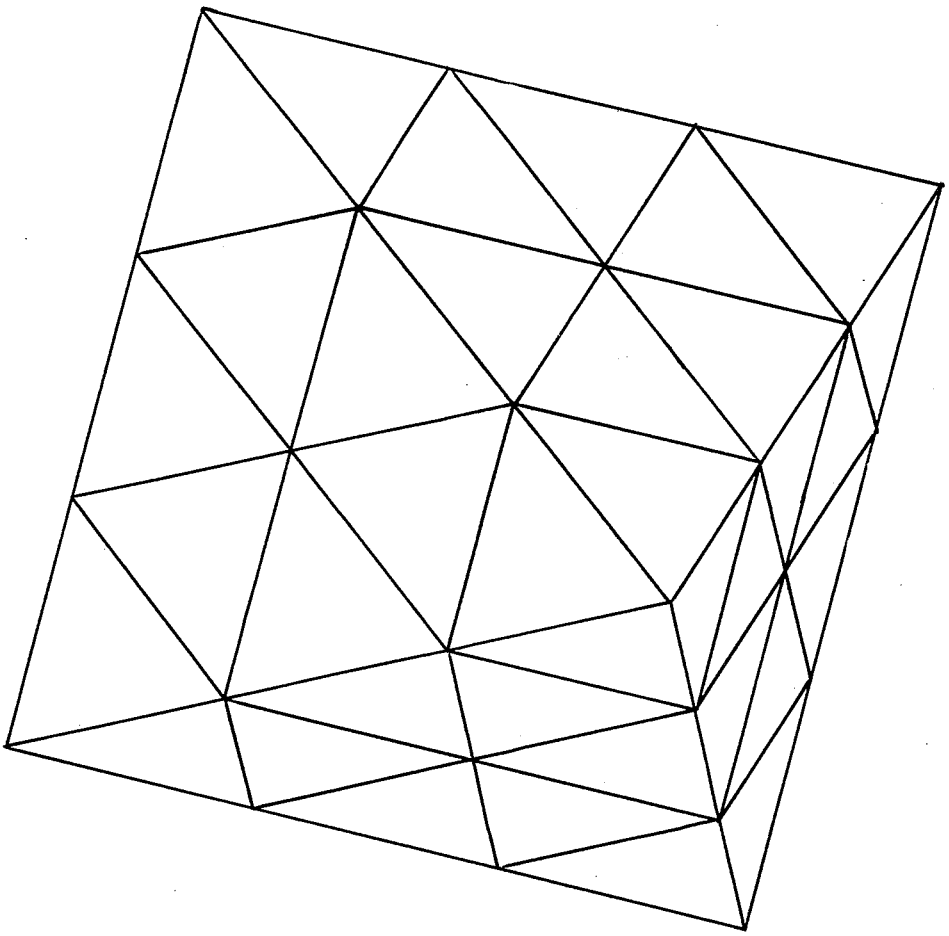
FIG. 7 is a view of the assembled puzzle.

FIG. 6 shows a view of an exterior tetrahedron 5 with a part cut away on one interior face and with feet 18 added on the two other interior faces.

The entire assembly of component parts is then held together as a unit as follows. The interior tetrahedra 4 are held by screws to the center octahedron. The feet 12 of the edge octahedra 2 project into the cut-away portions of the interior tetrahedra 4 and are therefore held in place by the interior tetrahedra. The feet 18 of the exterior tetrahedra 5 project into the cut-away portions of the edge octahedra 2 and are therefore held in place by the edge octahedra. Finally, the feet 13 of the corner octahedra 3 project into the cut-away portions of the exterior tetrahedra.

The purpose of this construction is a three layer octahedron with top surfaces of each of the three layers as shown in FIGS. 1A, 1B, and 1C in which the component parts are identified by the numbers already assigned. FIG. 1A is the top layer, FIG. 1B is the middle layer, and FIG. 1C is the bottom layer. FIG. 8 is a view of the completed puzzle. Each of the three layers can be rotated 120 degrees with respect to the other layers after which the original shape of the octahedron has been restored, but with different arrangements of faces. Thus the result is a mechanical puzzle comprising a plurality of component octahedra and a plurality of component tetrahedra in the shape of a regular octahedron. Means are provided in the form of cut-away portions, feet, screws, etc. to retain said component octahedra and component tetrahedra into a main unit. Each of the faces of said main unit is subdivided into nine smaller equilateral triangles which are themselves faces of said component octahedra and component tetrahedra. The circular cut-away sections permit rotation of the set of component octahedra and component tetrahedra which constitute a single face 120 degrees about an axis perpendicular to such face whereby a new arrangement of said component octahedra and component tetrahedra comes about while the entire assembly of component octahedra and tetrahedra remains a unit.

While this invention has been described with respect to preferred embodiments and illustrative examples thereof, it is clearly understood by those skilled in the art that the invention is not limited thereto and that the preferred embodiment is merely of illustrative purposes. Prior art arrangements indicate that the axles for rotation may comprise rivets, screws or any equilavents or substitutes therefor which will enable rotation of a set of component tetrahedra and octahedra comprising a face. Also the feet can have varying shapes and can be made of varying materials and still accomplish the main purpose of locking the components together into a main unit. Also it is within the spirit of the present invention to change the exterior surface shape, for example, by cutting off corners, or making the exterior faces curved, so that the main unit might exist in the shape of a sphere or other shape without changing the interior mechanism. Finally, the cut-away sections may depart from the circular shape provided the shape enables rotation of the layers about the various axes.

What I claim is new and desire to secure by Letters Patent of the United States is:

1. A mechanical puzzle comprising a plurality of component edge and corner octahedra and a plurality of component tetrahedra, a center member, the individual faces of such component octahedra and tetrahedra comprising equilateral triangles of the same size, means for retaining such component octahedra and tetrahedra into a main unit about said center member having the shape of a regular octahedron, comprising means for retaining each face of each component octahedron adjacent to the face of a component tetrahedron or exposed to the outside world but not adjacent to the face of said center member, means for retaining each face of each component tetrahedron adjacent to the face of a component octahedron, to the face of said center member or exposed to the outside world.

2. An arrangement according to claim 1 wherein said center member is provided at the center of said main unit and means for rotationally attaching interior faces of eight selected ones of said component tetrahedra at given angles to said center member.

3. An arrangement according to claim 2 wherein said center member is an octahedron.

4. An arrangement according to claim 1 comprising means providing a center octahedron a said center of said main unit which center octahedron presents no face to the outside world, said component octahedra comprising 12 edge octahedra, one at the center of each of the 12 edges of the main unit, each of said 12 edge octahedra presents 2 faces to the outside world, said component octahedra further comprising 6 corner octahedra one at each corner of said main unit, each such corner octahedron presents 4 faces to the outside world, said component tetrahedra comprising 8 interior tetrahedra wherein each of said interior tetrahedra presents no face to the outside world, one of said 8 interior tetrahedra being adjacent to each of the 8 faces of said center octahedron, said component tetrahedra further comprising 24 exterior tetrahedra, each of said exterior tetrahedra presents one face to the outside world and occupies space between an edge octahedron and a corner octahedron.

5. A mechanical puzzle comprising a plurality of component edge and corner octahedra and a plurality of component tetrahedra, a central member, means to retain said component octahedra and component tetrahedra into a main unit about said central member having the shape of a regular octahedron, each of the eight faces of said main unit being subdivided into nine smaller equilateral triangles which are themselves faces of said component octahedra and component tetrahedra, means for moving each set of component octahedra and component tetrahedra which constitute a single face of the main octahedron 120 degrees about an axis perpendicular to such face whereby a new arrangement of said component octahedra and component tetrahedra comes about while the entire assembly of component octahedra and tetrahedra retains the shape of said main unit.

6. A mechanical puzzle comprising a plurality of component first units of a first shape and a plurality of component edge and corner second units of different shape wherein each of said second units have a larger number of faces than said first units, a central member, means for retaining such component first and second units into a main unit about said central member having a given shape, comprising means for retaining each face of each component first unit adjacent to the face of a component second unit, to the face of said central member, or exposed to the outside world, and for retaining each face of each component second unit adjacent to the face of a component first unit or exposed to the outside world but not adjacent to the face of said central member, and means for rotationally attaching interior faces of eight selected ones of said component first units at given angles to said central member.

7. A mechanical puzzle comprising twenty-four exterior and eight interior component tetrahedra and six corner and twelve edge component octahedra, a central member, means to retain said component tetrahedra and octahedra in a main unit about said central member, said main unit having substantially the shape of a regular octahedron, said regular octahedron having six corner component octahedra, means for moving such corner octahedra only as part of one of four layers corresponding to four different axes which are perpendicular to respective ones of four different faces of the regular octahedron.

8. An arrangement according to claim 7 wherein said twelve edge component octahedra are each located between a different pair of component corner octahedra.

9. An arrangement according to claim 7 wherein said six corner and twelve edge component octahedra and said twenty-four exterior component tetrahedra have feet, said twelve edge octahedra, said central member and said twenty-four exterior and eight interior tetrahedra have cut away portions, means for holding said assembly of component parts into a main unit about said central member comprising means for rotatably attaching said eight interior tetrahedra to said central member, the feet of said edge octahedra projecting into the cut away portions of the interior tetrahedra and held in place thereby, the feet of the exterior tetrahedra projecting into the cut away portions of the edge octahedra and held in place therby, and the feet of the corner octahedra projecting into the cut away portion of the exterior tetrahedra and held in place thereby.

10. An arrangement according to claim 9 wherein said six corner octahedra with their feet are of a first shape and said twelve edge octahedra with their feet and cut away portions are of a second shape and said twenty-four exterior tetrahedra with their feet and cut away portions are of a third shape, and the eight interior tetrahedra with their cut away portions are of a fourth shape, and wherein said first, second, third and fourth shapes are different from one another.

* * * * *